US010981738B2

(12) United States Patent
Sekigawa

(10) Patent No.: US 10,981,738 B2
(45) Date of Patent: Apr. 20, 2021

(54) SHEET FEEDING APPARATUS AND IMAGE FORMING APPARATUS

(71) Applicant: CANON KABUSHIKI KAISHA, Tokyo (JP)

(72) Inventor: Akito Sekigawa, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/263,317

(22) Filed: Jan. 31, 2019

(65) Prior Publication Data

US 2019/0248614 A1 Aug. 15, 2019

(30) Foreign Application Priority Data

Feb. 13, 2018 (JP) ..... JP2018-023367

(51) Int. Cl.

| | |
|---|---|
| ***B65H 1/26*** | (2006.01) |
| ***B65H 3/68*** | (2006.01) |
| ***B65H 1/04*** | (2006.01) |
| ***G03G 15/00*** | (2006.01) |

(52) U.S. Cl.

CPC ..... *B65H 1/266* (2013.01); *B65H 3/68* (2013.01); *G03G 15/6511* (2013.01); *G03G 2221/1684* (2013.01)

(58) Field of Classification Search

CPC ..... B65H 1/266; B65H 1/04; B65H 2601/11; B65H 2601/2531; B65H 2601/253; B65H 2601/255; B65H 2404/611; B65H 2404/6111; B65H 5/38; B65H 3/68; B65H 7/06; B65H 7/14; G03G 2221/1672; G03G 2221/1675; G03G 15/6511; G03G 2221/1684

See application file for complete search history.

(56) References Cited

U.S. PATENT DOCUMENTS

| | | | | |
|---|---|---|---|---|
| 5,908,190 | A * | 6/1999 | Tanaka | B65H 5/00 271/225 |
| 8,087,667 | B2 | 1/2012 | Sekigawa | |
| 8,240,664 | B2 | 8/2012 | Sekigawa | |
| 8,500,122 | B2 | 8/2013 | Kushida et al. | |
| 8,550,461 | B2 | 10/2013 | Sekigawa et al. | |
| 9,067,753 | B2 | 6/2015 | Tokuma et al. | |
| 9,665,055 | B2 | 5/2017 | Sekigawa | |
| 9,738,469 | B2 | 8/2017 | Sekigawa | |

(Continued)

FOREIGN PATENT DOCUMENTS

| | | | |
|---|---|---|---|
| JP | 05085632 | A * | 4/1993 |
| JP | 11322094 | A * | 11/1999 |

(Continued)

*Primary Examiner* — Luis A Gonzalez
(74) *Attorney, Agent, or Firm* — Venable LLP

(57) ABSTRACT

A sheet feeding apparatus includes a drawer unit having a sheet supporting portion, a feeding roller to feed the sheet, a conveyance roller pair, and first and second conveyance guides. An abutment surface, formed integrally with the first conveyance guide, abuts against the sheet and guides the sheet toward the drawer unit. The abutment surface is inclined upstream from a downstream side in a sheet feeding direction toward a downstream side from an upstream side in a drawing direction and overlaps with the second conveyance guide when viewed in the drawing direction.

10 Claims, 18 Drawing Sheets

(56) References Cited

U.S. PATENT DOCUMENTS

| | | | | |
|---|---|---|---|---|
| 9,932,195 | B2 | 4/2018 | Sekigawa | |
| 2014/0030000 | A1 | 1/2014 | Gamo et al. | |
| 2016/0214816 | A1* | 7/2016 | Sugiyama | B65H 5/062 |
| 2019/0127166 | A1* | 5/2019 | Ochi | B65H 7/12 |

FOREIGN PATENT DOCUMENTS

| | | | | |
|---|---|---|---|---|
| JP | 2001261189 | A | * | 9/2001 |
| JP | 2009-047997 | A | | 3/2009 |
| JP | 2010120740 | A | * | 6/2010 |
| JP | 2016030688 | A | * | 3/2016 |

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets and an image forming apparatus including the sheet feeding apparatus.

Description of the Related Art

In general, image forming apparatuses such as printers, facsimiles, and copying machines include a sheet feeding apparatus. The sheet feeding apparatus includes a cassette for storing sheets, and a feeding unit for feeding the sheets stored in the cassette. The cassette can be attached to and drawn from the apparatus body of a corresponding image forming apparatus. However, the sheet may be jammed, stuck across a boundary portion between the cassette and the apparatus body. If the cassette is drawn from the apparatus body in this state, the sheet may be torn in the boundary portion, or caught in the apparatus body. As a result, the jam handling will become difficult, or otherwise a torn piece of the sheet will be left in the apparatus body, making it difficult to resolve the jam state.

As countermeasures, Japanese Patent Application Publication No. 2009-47997 proposes one image forming apparatus. The image forming apparatus has a plurality of units which can be drawn from the apparatus body; and controls the conveyance of sheets so that, when one sheet is jammed, other sheets being conveyed in the apparatus are not stuck across a boundary portion between the apparatus body and the units.

However, in the image forming apparatus of Japanese Patent Application Publication No. 2009-47997, the jammed sheet or the other sheets left in the apparatus cannot be conveyed. Consequently, the jammed sheet remains stuck across a boundary portion between the apparatus body and the units, making the jam handling difficult.

SUMMARY OF THE INVENTION

According to a first aspect of the present invention, a sheet feeding apparatus includes an apparatus body, a drawer portion configured to be drawn from and attached to the apparatus body and including a sheet supporting portion configured to support a sheet, a feeding portion configured to feed the sheet, supported by the sheet supporting portion, in a sheet feeding direction orthogonal to a drawing direction in which the drawer portion is drawn, a conveyance portion configured to convey the sheet fed by the feeding portion, a first conveyance guide and a second conveyance guide facing each other and forming a conveyance path through which the sheet fed from the feeding portion toward the conveyance portion passes, and an abutment surface disposed downstream of a sheet conveyance area, through which the sheet passes, of the conveyance path in the drawing direction, overlaps with the conveyance path when viewed in the drawing direction, and configured to abut against the sheet and guide the sheet toward the drawer portion in a case where the drawer portion is drawn from the apparatus body in a state where the sheet is stuck across the drawer portion and the conveyance path, the abutment surface being inclined downward as the abutment surface extends downstream in the drawing direction, the abutment surface being inclined downward as the abutment surface extends upstream in the sheet feeding direction.

According to a second aspect of the present invention, a sheet feeding apparatus includes an apparatus body, a drawer portion configured to be drawn from and attached to the apparatus body and including a sheet supporting portion configured to support a sheet, a feeding portion configured to feed the sheet, supported by the sheet supporting portion, in a sheet feeding direction orthogonal to a drawing direction in which the drawer portion is drawn, a conveyance portion configured to convey the sheet fed by the feeding portion, a first conveyance guide and a second conveyance guide facing each other and forming a conveyance path through which the sheet fed from the feeding portion toward the conveyance portion passes, and an abutment surface disposed downstream of a sheet conveyance area, through which the sheet passes, of the conveyance path in the drawing direction, overlaps with the conveyance path when viewed in the drawing direction, and configured to abut against the sheet and guide the sheet toward the drawer portion in a case where the drawer portion is drawn from the apparatus body in a state where the sheet is stuck across the drawer portion and the conveyance path, the abutment surface including an upper edge portion and a lower edge portion, the abutment surface being inclined with respect to the drawing direction and the sheet feeding direction such that the upper edge portion is located upstream of the lower edge portion in the drawing direction, and is located downstream of the lower edge portion in the sheet feeding direction.

Further features of the present invention will become apparent from the following description of exemplary embodiments with reference to the attached drawings.

DESCRIPTION OF THE EMBODIMENTS

First Embodiment

Overall Configuration

Figure 1:
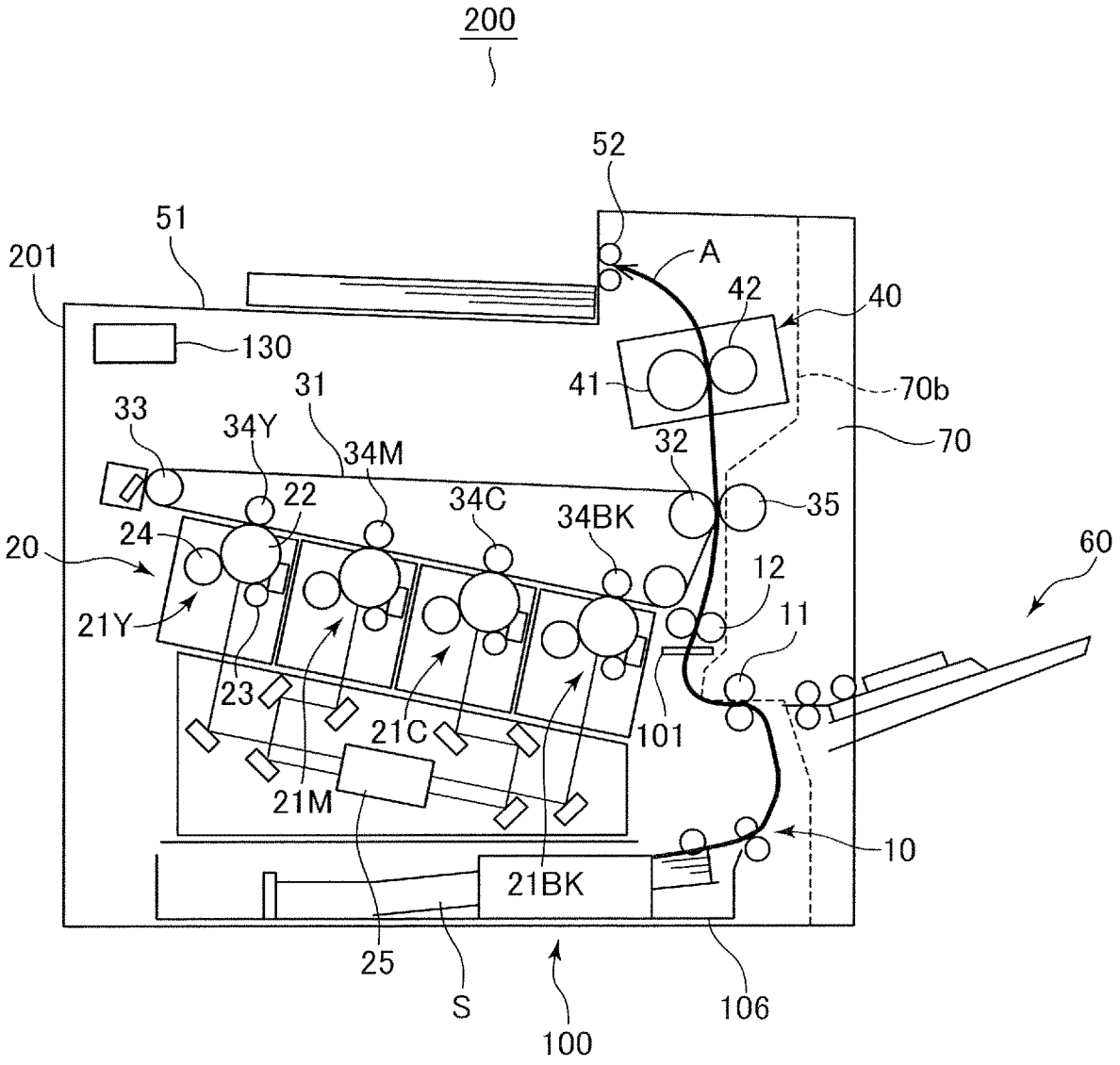
FIG. 1 is an overall schematic diagram of a printer of a first embodiment.

First, a first embodiment of the present invention will be described. A printer 200, which serves as an image forming apparatus, is an electrophotographic laser beam printer. As illustrated in FIG. 1, the printer 200 includes an image forming portion 20 to form an image on a sheet S, a sheet feeding apparatus 100, and a fixing apparatus 40. The image forming portion 20 includes four process cartridges 21Y, 21M, 21C, and 21BK, and a scanner unit 25. The four process cartridges are used to form four toner images of yellow (Y), magenta (M), cyan (C), and black (BK).

Here, since the four process cartridges 21Y, 21M, 21C, and 21BK are the same as each other, except that they produce different colors of image, a configuration and an image forming process of only the process cartridge 21Y will be described, and the description for the process cartridges 21M, 21C, and 21BK will be omitted.

The process cartridge 21Y includes a photosensitive drum 22, a charging roller 23, and a developing roller 24. The photosensitive drum 22 has an aluminum cylinder and an organic photoconductive layer with which the outer surface of the aluminum cylinder is coated, and is rotated by a driving motor (not illustrated). In addition, the image forming portion 20 includes an intermediate transfer belt 31 wound around a driving roller 32 and a tension roller 33. Inside the intermediate transfer belt 31, primary transfer rollers 34Y, 34M, 34C, and 34BK are disposed.

The fixing apparatus 40 includes a fixing film 41 which is heated by a heater (not illustrated), and a pressure roller 42 which is in pressure contact with the fixing film 41. The sheet feeding apparatus 100 is disposed in a lower portion of the printer 200, and includes a cassette 106 and a feed unit 10. The cassette 106 stores sheets and serves as a drawer portion, and the feed unit 10 feeds the sheets.

Next, an image forming operation of the printer 200 configured in this manner will be described. When the scanner unit 25 receives an image signal from an apparatus, such as a personal computer (not illustrated), the scanner unit 25 irradiates the photosensitive drum 22 of the process cartridge 21Y, with a laser beam in accordance with the image signal.

Since the surface of the photosensitive drum 22 is uniformly charged in advance by the charging roller 23 so as to have a predetermined polarity and potential, an electrostatic latent image is formed on the surface when the surface is irradiated with the laser beam from the scanner unit 25. The electrostatic latent image formed on the photosensitive drum 22 is developed by the developing roller 24, and a yellow (Y) toner image is formed on the photosensitive drum 22.

Similarly, photosensitive drums of the process cartridges 21M, 21C, and 21BK are also irradiated with laser beams from the scanner unit 25, and magenta (M), cyan (C), and black (BK) toner images are formed on the photosensitive drums. The toner images formed on the respective photosensitive drums and having respective colors are transferred onto the intermediate transfer belt 31 by the primary transfer rollers 34Y, 34M, 34C, and 34BK; and conveyed to the secondary transfer roller 35 by the intermediate transfer belt 31, which is rotated by the driving roller 32. Here, the image forming process for each color is performed at a timing at which one toner image is transferred onto another toner image which has been primary-transferred onto the intermediate transfer belt 31 at a position upstream of the one toner image.

In synchronization with the image forming process, the sheet S stored in the cassette 106 of the sheet feeding apparatus 100 is fed by the feed unit 10, and conveyed to a registration roller pair 12 through a conveyance roller pair 11. At a position upstream of the registration roller pair 12 in the sheet conveyance direction, a top sensor 101 is disposed to detect the leading edge and the trailing edge of the sheet S which is being conveyed. The registration roller pair 12 corrects the skew of the sheet S, and then the sheet S is conveyed at a predetermined conveyance timing, depending on a detection result by the top sensor 101. Then a full-color toner image on the intermediate transfer belt 31 is transferred onto the sheet S by a secondary transfer bias applied to a secondary transfer roller 35.

The sheet S onto which the toner image has been transferred is then applied with predetermined heat and pressure by the fixing film 41 and the pressure roller 42 of the fixing apparatus 40, and thereby the toner is melted and adheres to the sheet S (that is, fixed to the sheet S). Then the sheet S passes through the fixing apparatus 40, and is discharged to a discharging tray 51 by a discharge roller pair 52. An arrow A of FIG. 1 indicates an example of a conveyance path along which the sheet S is conveyed from the cassette 106 to the discharge roller pair 52.

In addition, the printer 200 also includes a cover 70 and a multi-feeding apparatus 60. The cover 70 is used for handling jam, and is supported by a printer body 201 (which serves as an apparatus body) so as to be opened and closed. The cover 70 can be moved away from the printer body 201 at a boundary 70*b* for facilitating the jam handling.

Sheet Feeding Apparatus

Figure 2:
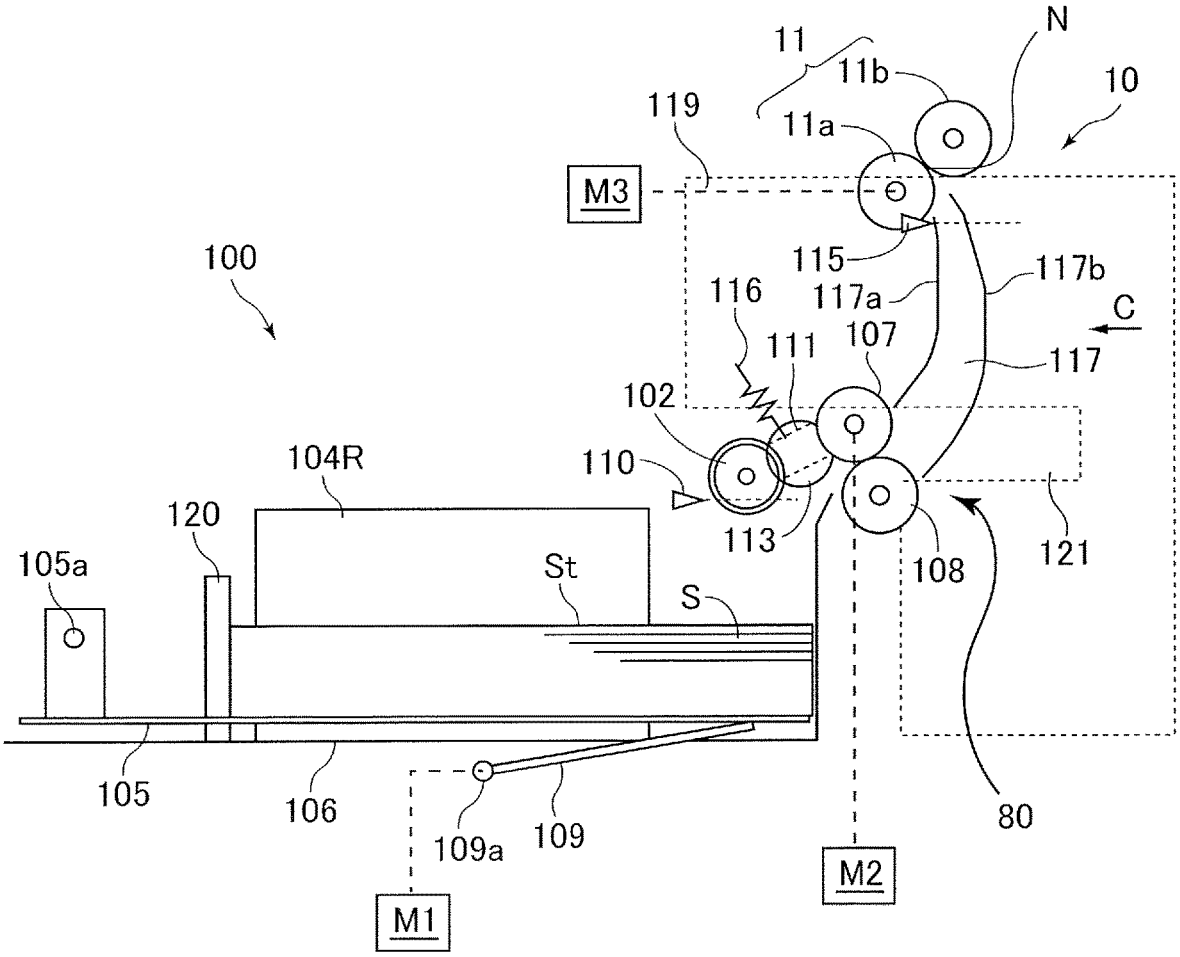
FIG. 2 is a schematic diagram illustrating a sheet feeding apparatus.

As illustrated in FIG. 2, the sheet feeding apparatus 100 includes the above-described cassette 106 and the feed unit 10. The cassette 106 supports a tray 105, which serves as a sheet supporting portion to support the sheet S, such that the tray 105 can pivot on a pivot center 105*a*. Below the tray 105, a lifter plate 109 is supported such that the lifter plate 109 can pivot on a pivot center 109*a*. When the lifter plate 109 is pivoted by a tray lifting-and-lowering motor M1, the tray 105 is moved up by the lifter plate 109 pushing the tray 105 from below. The height of an uppermost sheet St of the sheets S stacked on the tray 105 is detected by a sheet height sensor 110.

Figure 3A:
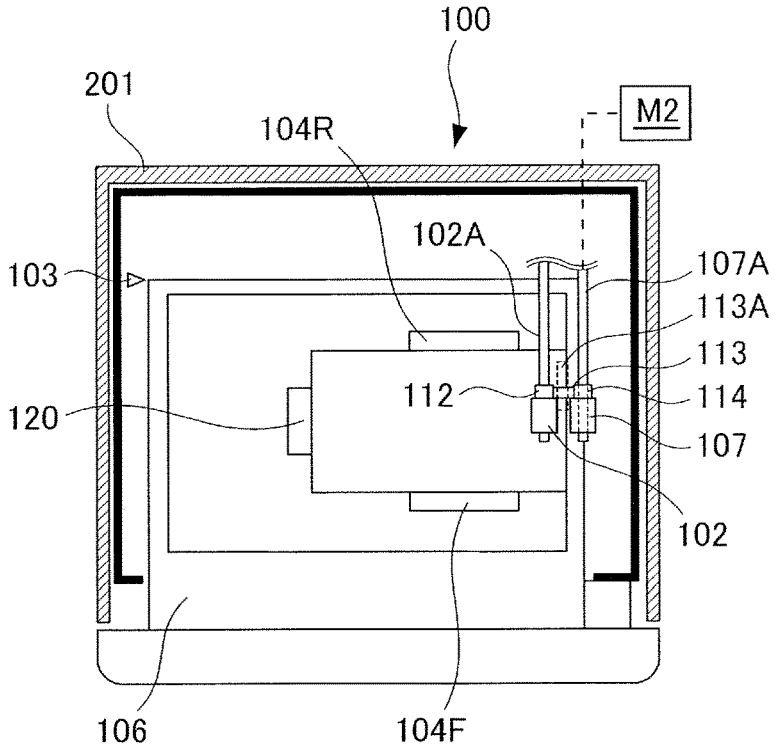
FIG. 3A is a plan view illustrating the sheet feeding apparatus in a state where a cassette is attached.
Figure 3B:
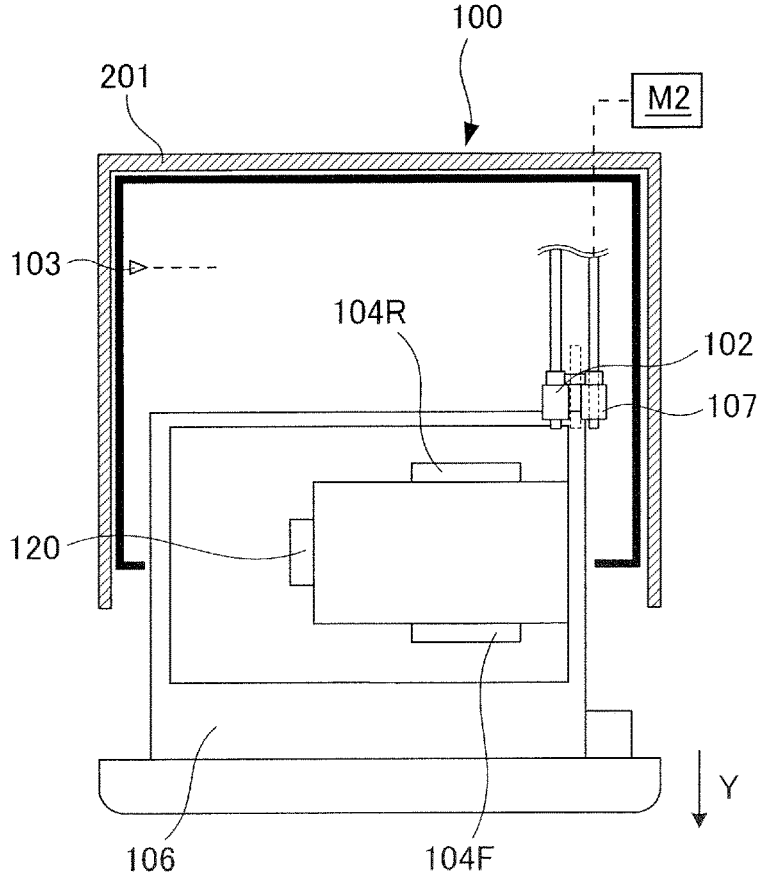
FIG. 3B is a plan view illustrating the sheet feeding apparatus in a state where the cassette is drawn.

The cassette 106 can be attached to the printer body 201, as illustrated in FIG. 3A; and can be drawn from the printer body 201 toward a drawing direction (i.e. direction indicated by an arrow Y of FIG. 3B), as illustrated in FIG. 3B. In a space of the printer body 201 in which the cassette 106 is placed, a cassette sensor 103 is disposed to detect the cassette 106 attached to the printer body 201. In addition, as illustrated in FIGS. 2 to 3B, side regulation plates 104F and 104R and a trailing edge regulation plate 120 are disposed in the cassette 106. The trailing edge regulation plate 120 is supported so as to be able to move in the sheet feeding direction, and regulates the position of the trailing edge of the sheet S stacked on the tray 105. Here, the trailing edge is the upstream edge of the sheet S in the sheet feeding direction.

The side regulation plates 104F and 104R can abut against edges of the sheet S, stacked on the tray 105, in a width direction orthogonal to the sheet feeding direction; and can slide in the width direction. In addition, the side regulation plates 104F and 104R have respective racks (not illustrated) extending in the width direction. These racks mesh with each other via pinion gears (not illustrated), so that the side regulation plates 104F and 104R can move with each other.

The feed unit 10 includes a pickup roller 102, a feed roller 107, a retard roller 108, the conveyance roller pair 11, a first conveyance guide 117*a*, a second conveyance guide 117*b*, and a feed frame 119. The pickup roller 102, the feed roller 107, and the retard roller 108 constitute a feeding portion 80 which feeds sheets. The first conveyance guide 117*a* and the second conveyance guide 117*b* are curved guides facing each other, and form a conveyance path 117 extending from the feed roller 107 to the conveyance roller pair 11. The second conveyance guide 117*b* is located outside the curved conveyance path 117 which extends upward toward the conveyance roller pair 11, and pivotally supported by the feed frame 119. When the second conveyance guide 117*b* is separated from the first conveyance guide 117*a*, the conveyance path 117 can be opened. The second conveyance guide 117*b* may be formed integrally with the cover 70 which serves as a door, and thus, the conveyance path 117 can be opened by opening the cover 70.

The conveyance roller pair 11 which serves as a conveyance portion includes a driving roller 11*a* and a driven roller 11*b*. The driving roller 11*a* is driven by a conveyance driving motor M3, and the driven roller 11*b* is in contact with the driving roller 11*a*, and driven by the driving roller 11*a*. The driving roller 11*a* and the driven roller 11*b* form a conveyance nip N, through which the sheet S is conveyed. In addition, a sheet position sensor 115 is disposed downstream of the pickup roller 102 in the sheet feeding direction and upstream of the conveyance nip N, to detect the sheet S in the conveyance path 117.

The feed roller 107 is rotatably supported by a feed shaft 107A. The feed shaft 107A supports a holder 111 so that the holder 111 can swing. The holder 111 supports an idler shaft 113A and a pickup shaft 102A so that the idler shaft 113A and the pickup shaft 102A can rotate. The pickup shaft 102A supports the pickup roller 102 so that the pickup roller 102 can rotate.

The feed shaft 107A, the idler shaft 113A, and the pickup shaft 102A respectively support a feed gear 114, an idler gear 113, and a pickup gear 112. When the feed shaft 107A is driven by the feed driving motor M2, the rotation of the feed shaft 107A is transmitted to the pickup roller 102 via the feed gear 114, the idler gear 113, the pickup gear 112, and a coupling mechanism (not illustrated). With this configuration, the pickup roller 102 rotates, and the sheet S stacked on the tray 105 is fed. The holder 111 is urged downward by a pickup spring 116. The feed shaft 107A and the pickup shaft 102A are rotatably supported by the feed frame 119 of the printer body 201 (see FIG. 1).

The feed frame 119, which serves as one frame, is provided with an opening 121. The opening 121 is located in the vicinity of the feed roller 107, and is opened downstream in the drawing direction of the cassette 106. The opening 121 is exposed to the outside when the cassette 106 is drawn from the printer body 201, but is covered with a frame of the cassette 106 and is not exposed to the outside when the cassette 106 is attached to the printer body 201. Thus, while the cassette 106 is attached to the printer body 201, dust can be prevented from entering the printer body 201 through the opening 121.

Figure 4:
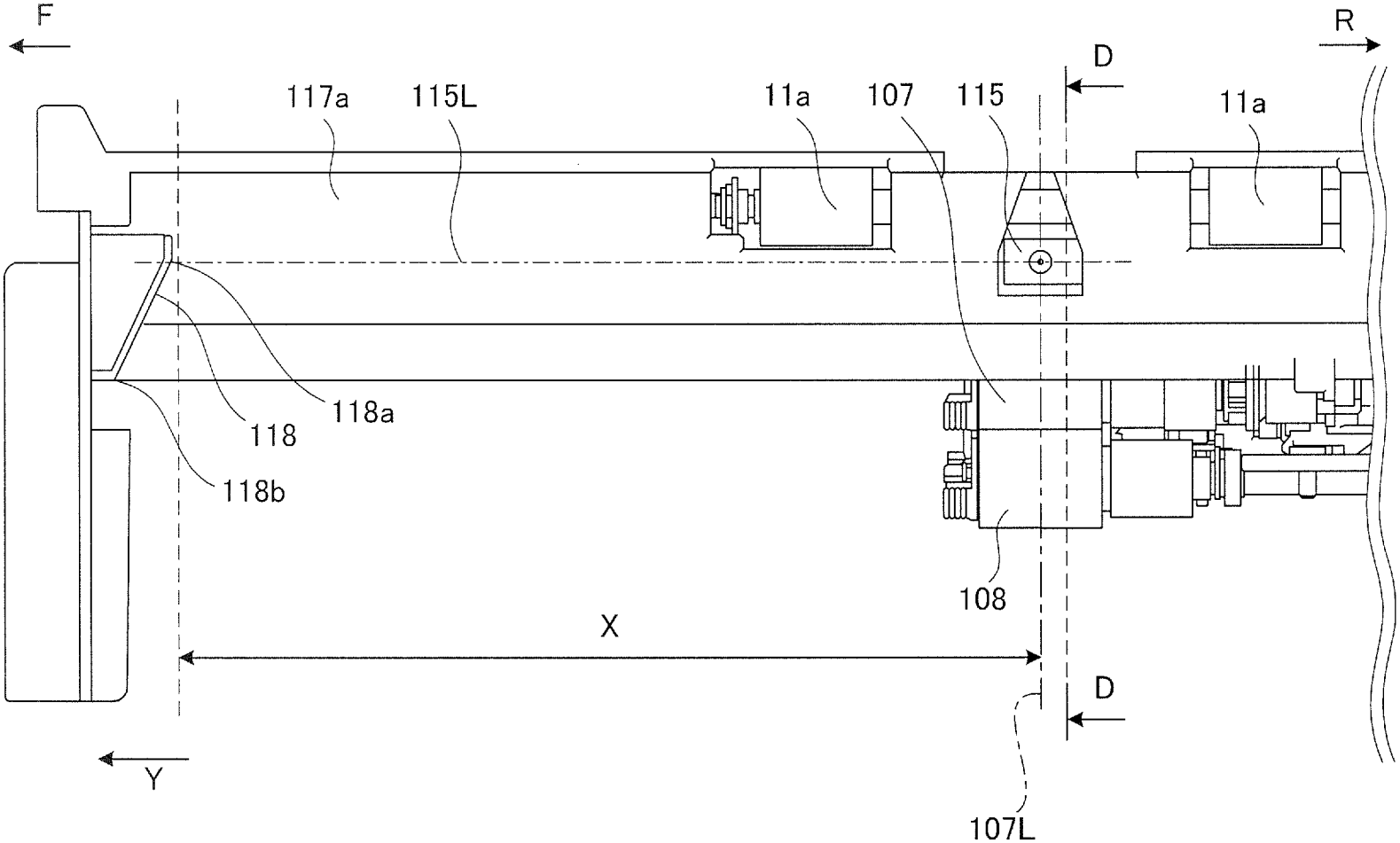
FIG. 4 is a diagram in which a first conveyance guide is seen from a direction indicated by an arrow C of FIG. 2.

FIG. 4 is a diagram in which the first conveyance guide 117*a* is seen from a direction indicated by an arrow C of FIG. 2. In FIG. 4, an arrow F indicates a side on which the front face of the printer 200 is located, and an arrow R indicates a side on which the back face of the printer 200 is located. As illustrated in FIG. 4, a center line 107L of the feed roller 107 and the retard roller 108 in their width direction coincides with a center line of the sheet S (stacked on the tray 105, as illustrated in FIG. 2) in its width direction. As described above, a detecting-position line 115L of the sheet position sensor 115 is located upstream of the conveyance nip N (see FIG. 2) in the sheet feeding direction.

In FIG. 4, a distance X is equal to half the width of a maximum-size sheet guided by the first conveyance guide 117*a*. That is, an area, half of which has the distance X between the center line 107L and an edge of the area in the width direction, is a sheet conveyance area through which the sheet S passes along the conveyance path 117. In addition, a jam-handling guide surface 118 is disposed downstream of the sheet conveyance area in the drawing direction (indicated by the arrow Y) to guide a jammed sheet. The jam-handling guide surface 118 is one example of abutment surfaces. In the present embodiment, the jam-handling guide surface 118 is formed integrally with the first conveyance guide 117*a*.

Detailed Structure of Jam-Handling Guide Surface

Figure 5:
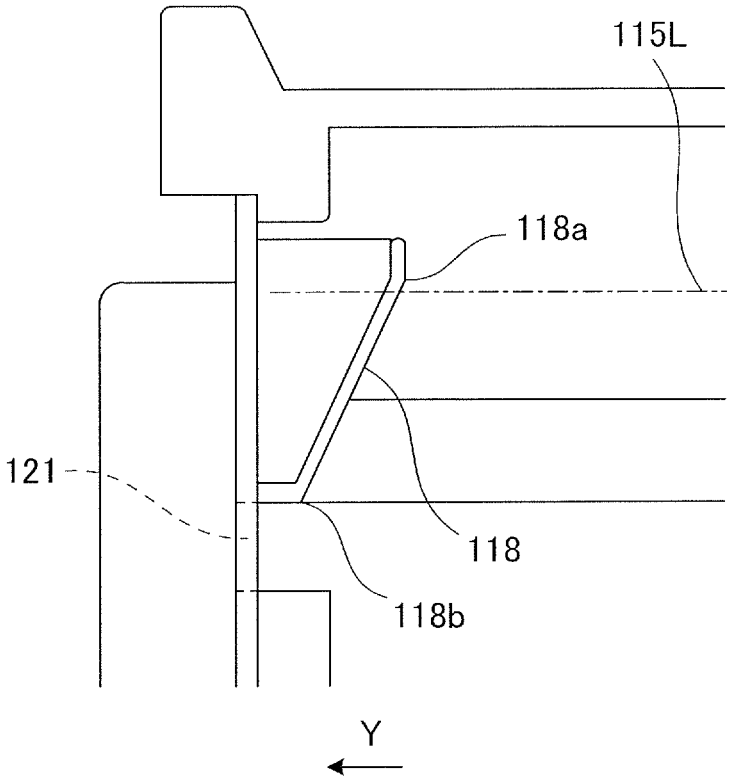
FIG. 5 is an enlarged view illustrating a jam-handling guide surface.
Figure 6:
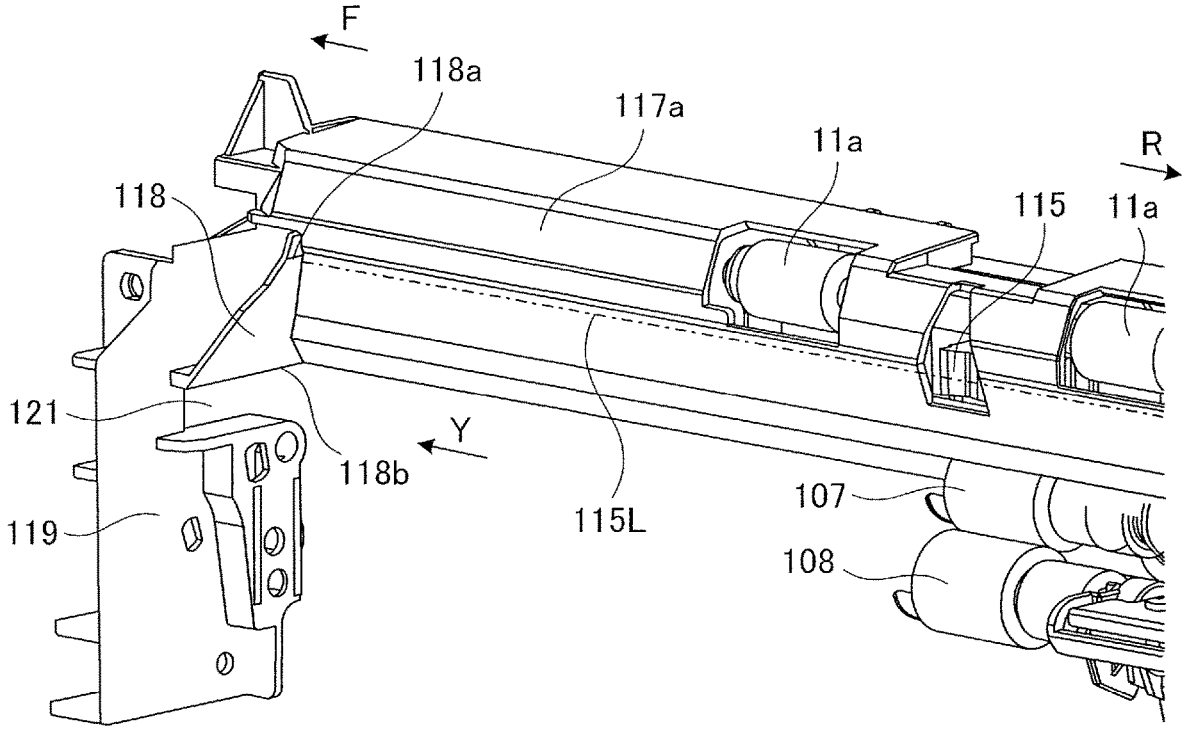
FIG. 6 is a perspective view illustrating the jam-handling guide surface and the first conveyance guide.

Next, a detailed structure of the jam-handling guide surface 118 will be described. As illustrated in FIGS. 5 and 6, the jam-handling guide surface 118 has an upper edge portion 118*a* and a lower edge portion 118*b*. The upper edge portion 118*a* is positioned downstream of the detecting-position line 115L of the sheet position sensor 115 in the sheet feeding direction, and the lower edge portion 118*b* is positioned at the same height as that of the upper edge of the opening 121 of the feed frame 119.

The jam-handling guide surface 118 is formed such that a line from the upper edge portion 118*a* to the lower edge portion 118*b* is inclined with respect to the drawing direction (indicated by the arrow Y) and the sheet feeding direction. More specifically, the upper edge portion 118*a* is positioned upstream of the lower edge portion 118*b* in the drawing direction, and is positioned downstream of the lower edge portion 118*b* in the sheet feeding direction. That is, the jam-handling guide surface 118 is inclined with respect to the drawing direction and the sheet feeding direction such that the upper edge portion is positioned upstream of the lower edge portion 118*b* in the drawing direction and downstream of the lower edge portion in the sheet feeding direction.

Figure 7:
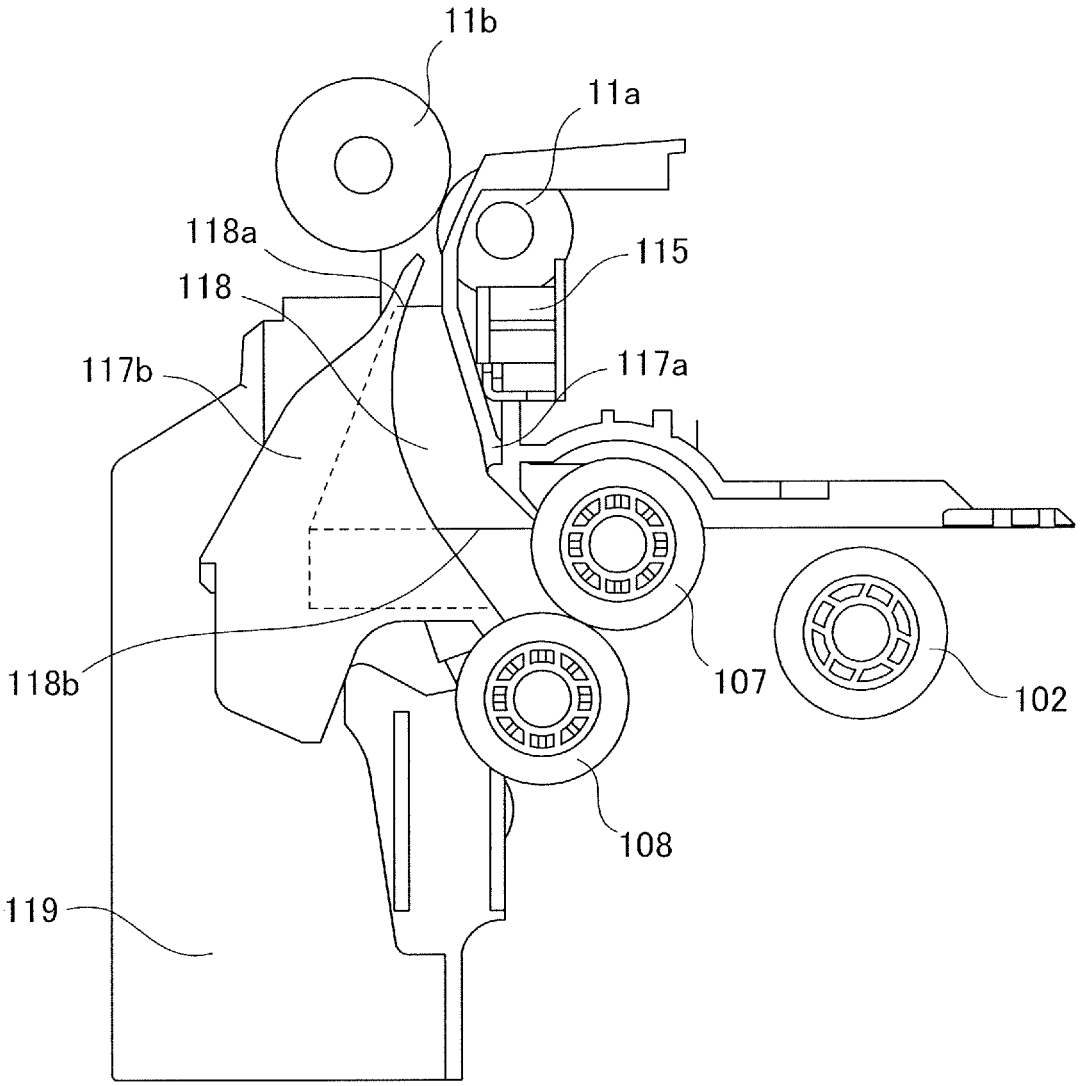
FIG. 7 is a cross-sectional view taken along a line D-D of FIG. 4.
Figure 8:
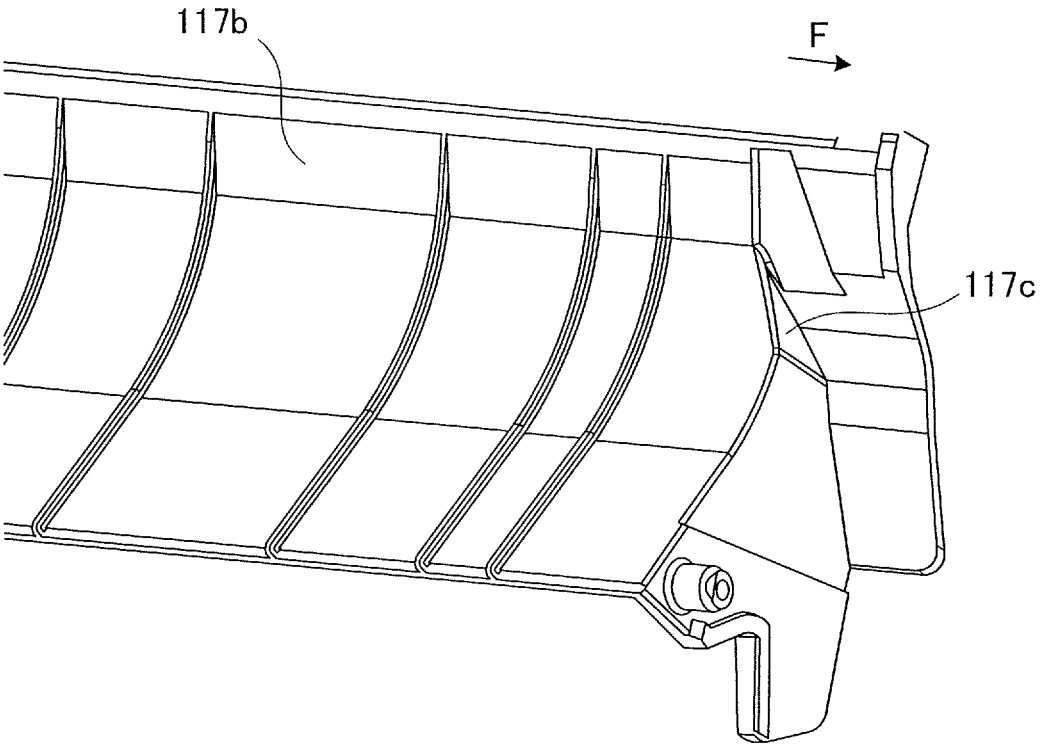
FIG. 8 is a perspective view illustrating a second conveyance guide.

FIG. 7 is a cross-sectional view taken along a line D-D of FIG. 4, and illustrates a positional relationship between the first conveyance guide 117*a*, the second conveyance guide 117*b*, and the jam-handling guide surface 118. The jam-handling guide surface 118 extends from the first conveyance guide 117*a* toward the second conveyance guide 117*b*, and overlaps with the second conveyance guide 117*b* when viewed in the drawing direction perpendicular to FIG. 7. As illustrated in FIG. 8, the second conveyance guide 117*b* is a component separate from the first conveyance guide 117*a*, and has a concave portion 117*c* in which the jam-handling guide surface 118, which protrudes from the first conveyance guide 117*a*, is placed.

As described above, the jam-handling guide surface 118 is disposed downstream of the sheet conveyance area of the conveyance path 117 in the drawing direction. Thus, when the cassette 106 is drawn in a state where a sheet is jammed stuck across the cassette 106 and the conveyance path 117, the jam-handling guide surface 118 can smoothly guide the jammed sheet toward the opening 121. In other words, the jam-handling guide surface 118 guides the jammed sheet toward the cassette 106 which is being drawn. Here, since the jam-handling guide surface 118 is located outside the sheet conveyance area as described above, the jam-handling guide surface 118 does not interfere with the sheet which is being conveyed through the conveyance path 117, unless the cassette 106 is drawn.

Control Block

Figure 9:
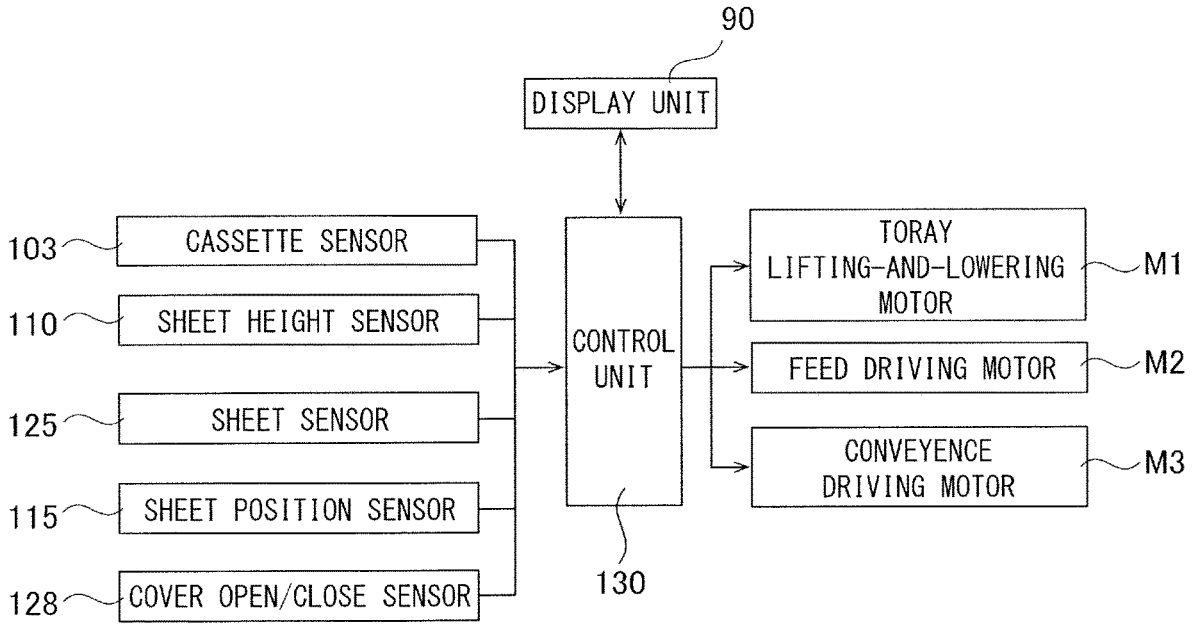
FIG. 9 is a control block diagram illustrating control blocks.

FIG. 9 is a control block diagram illustrating control blocks of the present embodiment. As illustrated in FIG. 9, the printer 200 includes a control unit 130. On the input side of the control unit 130, the control unit 130 is connected with the cassette sensor 103, the sheet height sensor 110, a sheet sensor 125, a sheet position sensor 115, and a cover open/close sensor 128. For example, the sheet sensor 125 includes a flag member which pivots when pushed by sheets stacked on the tray 105, and an optical sensor which can detect the flag member. With these components, the sheet sensor 125 can detect the sheets stacked on the tray 105.

On the output side of the control unit 130, the control unit 130 is connected with the tray lifting-and-lowering motor M1, the feed driving motor M2, and the conveyance driving motor M3. The control unit 130 may be disposed in the sheet feeding apparatus 100, or in another place of the printer 200 other than the sheet feeding apparatus 100. Furthermore, the control unit 130 is connected with a display unit 90. The display unit 90 includes a liquid crystal panel, and displays various messages. By operating the display unit 90, a user can change various settings of the printer 200.

Sheet Feeding Operation and Jam Handling Operation

Figure 10:
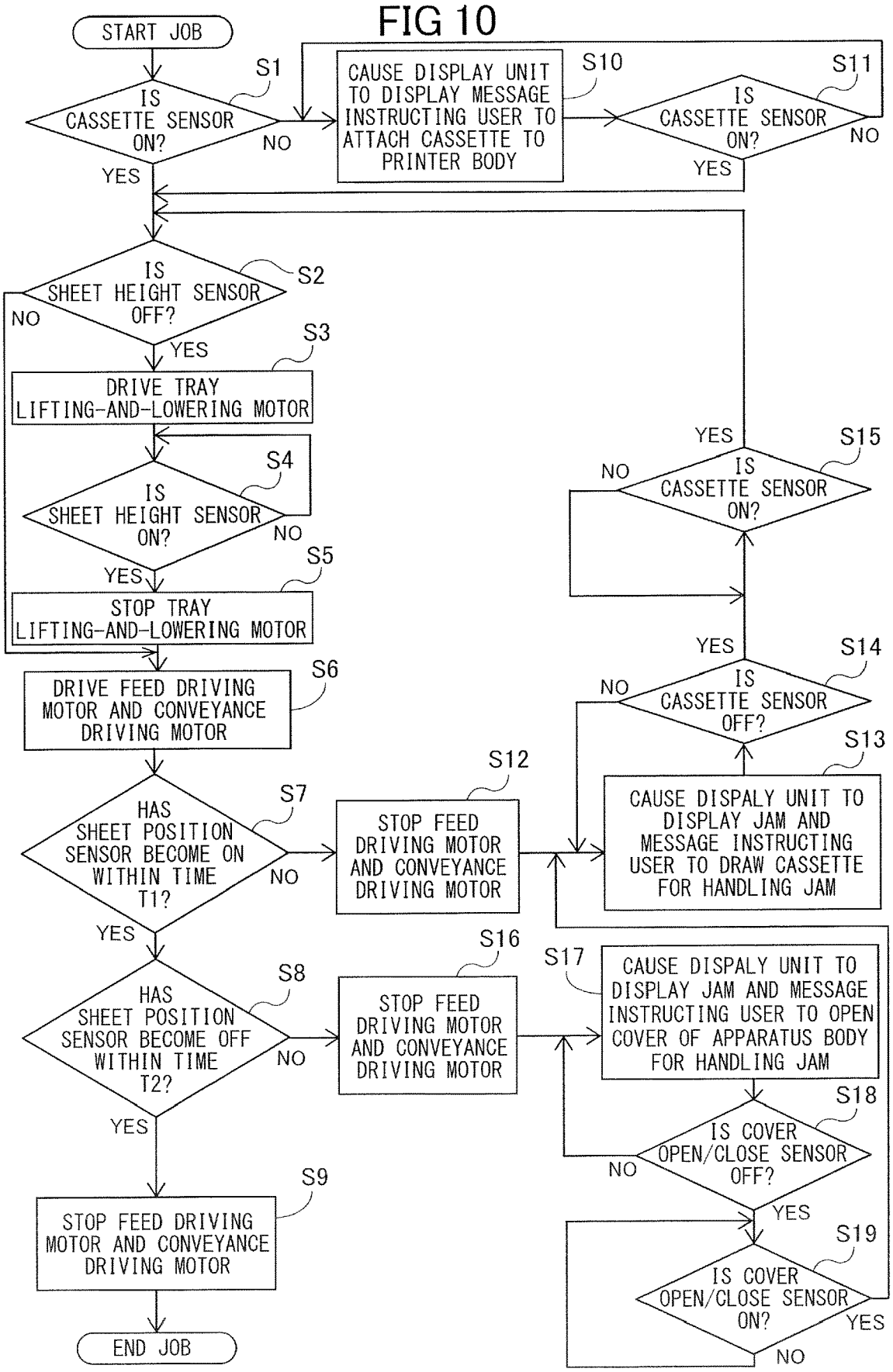
FIG. 10 is a flowchart illustrating a sheet feeding operation performed by the sheet feeding apparatus, and a jam handling operation performed when a jam occurs.

Next, a sheet feeding operation by the sheet feeding apparatus 100, and a jam handling operation performed when a jam occurs will be described with reference to the flowchart of FIG. 10. As illustrated in FIG. 10, when a print job for a single sheet is started, the control unit 130 first determines whether the cassette sensor 103 is ON (Step S1). If the control unit 130 determines that the cassette sensor 103 is not ON (Step S1: NO), then the control unit 130 causes the display unit 90 to display a message prompting a user to attach the cassette 106 to the printer body 201 (Step S10). Then control unit 130 determines again whether the cassette sensor 103 is ON (Step S11). The control unit 130 returns to Step S10 when determining that the cassette sensor 103 is not ON (Step S11: NO), or proceeds to Step S2 when determining that the cassette sensor 103 is ON (Step S11: YES).

When determining in Step S1 or S11 that the cassette sensor 103 is ON (Step 1 or 11: YES), the control unit 130 determines whether the sheet height sensor 110 is OFF (Step S2). If the sheet height sensor 110 is ON, then the control unit 130 proceeds to Step S6. If the sheet height sensor 110 is OFF, then the control unit 130 drives the tray lifting-and-lowering motor M1 (Step S3). With this operation, the lifter plate 109 pivots on the pivot center 109*a*, and pushes and lifts the tray 105. The control unit 130 then determines if the sheet height sensor 110 becomes ON. If not, the control unit 130 waits until the sheet height sensor 110 becomes ON (Step S4).

If the control unit 130 determines that the sheet height sensor 110 becomes ON, then the control unit 130 stops the tray lifting-and-lowering motor M1 (Step S5). With this operation, an uppermost sheet St stacked on the tray 105 is positioned at a feed position. Here, the pickup roller 102 is moved to an upper limit position when the cassette 106 is drawn, and is moved to a lower limit position by a pickup spring 116 when the cassette 106 is attached to the printer body 201. In addition, when the tray 105 is lifted in this state, the pickup roller 102 is lifted by the uppermost sheet St stacked on the tray 105 and stopped at the position at which the sheet height sensor 110 becomes ON. In this time, if the sheet sensor 125 detects sheets stacked on the tray 105, the feeding of the sheets can be started.

Then the control unit 130 drives the feed driving motor M2 and the conveyance driving motor M3, and starts feeding of the sheets (Step S6). The control unit 130 determines whether the sheet position sensor 115 has become ON within a time T1 measured from the start of the feeding to a predetermined time T1 (Step S7). If the control unit 130 determines that the sheet position sensor 115 has become ON within the time T1 (Step S7: YES), then the control unit 130 determines whether the sheet position sensor 115 has become OFF within a time T2 measured from the start of the feeding and longer than the time T1 (Step S8). Here, the time from the start of the feeding is measured for each of the sheets.

If the control unit 130 determines that the sheet position sensor 115 has become OFF within the time T2 (Step S8: YES), then the control unit 130 determines that the feed unit 10 has completed the feeding of one sheet, and proceeds to Step S9. That is, when the leading edge of a sheet is detected by the sheet position sensor 115 within the time T1 measured from the start of the feeding, and the trailing edge of the sheet passes the sheet position sensor 115 within the time T2, the sheet is normally fed. In this case, the control unit 130 stops the feed driving motor M2 and the conveyance driving motor M3 (Step S9), and ends the print job.

If the control unit 130 determines in Step S7 that the sheet position sensor 115 has not become ON within the time T1 (Step S7: NO) measured from the start of the feeding, then the control unit 130 stops the feed driving motor M2 and the conveyance driving motor M3 (Step S12). In such a case, the pickup roller 102 or the feed roller 107 may slip, causing sheet-delay jam. When the sheet-delay jam occurs, the sheet is conveyed less smoothly than expected, and the sheet may be stuck across the cassette 106 and the conveyance path 117. Thus, the control unit 130 causes the display unit 90 to display a message indicating that the jam has occurred and instructing a user to draw the cassette 106 from the printer body 201 for handling the jam (Step S13).

Then the control unit 130 determines if the cassette sensor 103 has become OFF (Step S14). If not, the control unit 130 waits until the cassette sensor 103 becomes OFF. When a user draws the cassette 106, the cassette sensor 103 becomes OFF (Step S14: YES). At this time, since the coupling between the cassette 106 and the printer body 201 is canceled in the driving-force transmission path extending from the tray lifting-and-lowering motor M1 to the lifter plate 109, the lifter plate 109 and the tray 105 move down due to their own weights. In addition, the pickup roller 102 moves up to a position at which the pickup roller 102 does not abut against the uppermost sheet St, and the separation nip between the feed roller 107 and the retard roller 108 is released.

When a user handles the jammed sheet and attaches the cassette 106 to the printer body 201, the cassette sensor 103 becomes ON (Step S15: YES). Then the control unit 130 returns the steps S2 and S3, and causes the tray 105 to move up and starts the feeding of the sheets again.

If the control unit 130 determines in Step S8 that the sheet position sensor 115 has not become OFF within the time T2 measured from the start of the feeding (Step S8: NO), then the control unit 130 stops the feed driving motor M2 and the conveyance driving motor M3 (Step S16). In such a case, a sheet may be stuck in the conveyance path 117, causing sheet-stuck jam. Thus, the control unit 130 causes the display unit 90 to display a message indicating that the jam has occurred and instructing a user to open the cover 70 for handling the jam (Step S17).

Figure 11:
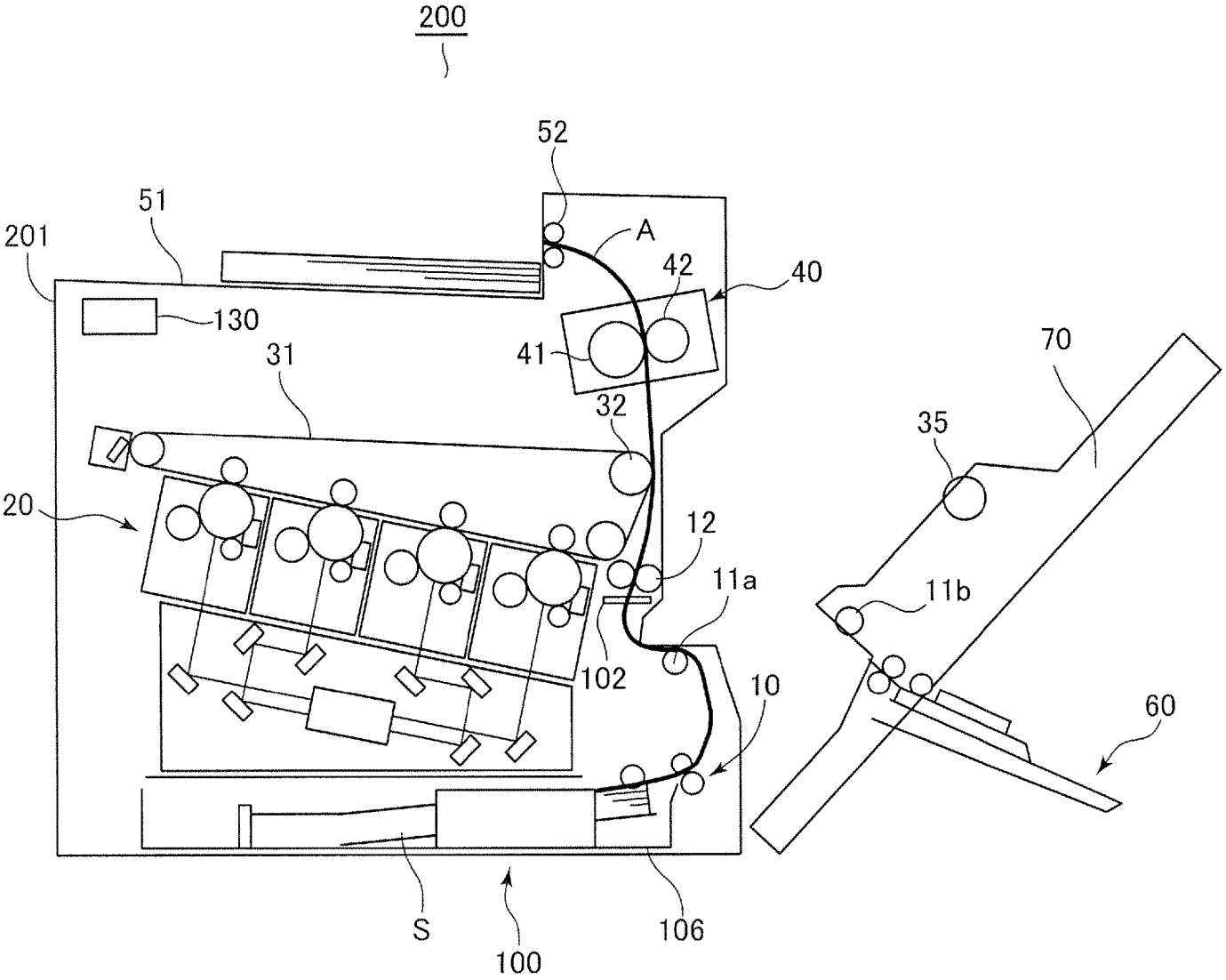
FIG. 11 is a schematic diagram illustrating the printer whose cover is opened.

Then the control unit 130 determines if the cover open/close sensor 128 has become OFF (Step S18). If not, the control unit 130 waits until the cover open/close sensor 128 becomes OFF. As illustrated in FIG. 11, when the cover 70 is opened by a user, the cover open/close sensor 128 becomes OFF (Step S18: YES), and the conveyance path 117 is opened, making the jam handling easier. When a user handles the jammed sheet and closes the cover 70 to close the printer body 201, the cover open/close sensor 128 becomes ON (Step S19: YES). Then the control unit 130 proceeds to the above-described Step S13.

Figure 12:
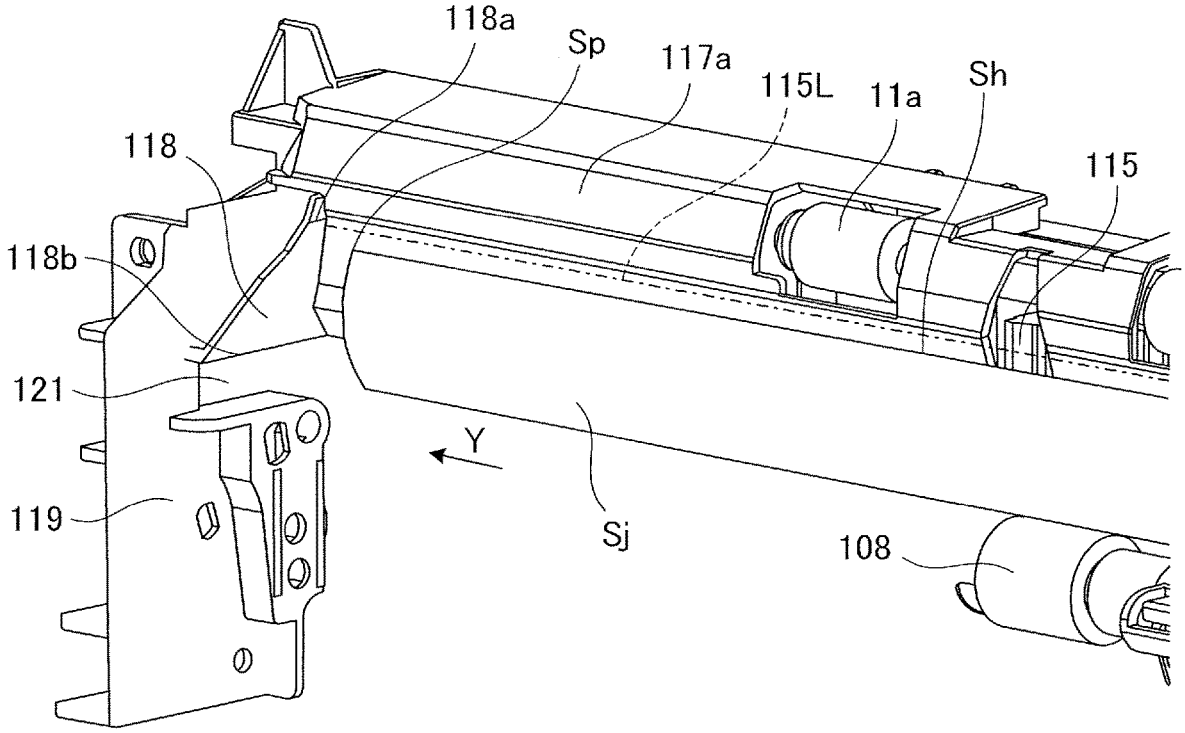
FIG. 12 is a perspective view illustrating a positional relationship between the jam-handling guide surface and the leading edge of a jammed sheet.

In the above-described jam handling flow (Step S12 to S15) in which the cassette 106 is drawn for handling the jam, a leading edge Sh of a jammed sheet Sj is located as illustrated in FIG. 12. The leading edge Sh of the jammed sheet Sj is located at a position at which the sheet position sensor 115 does not become ON, that is, located upstream of the detecting-position line 115L of the sheet position sensor 115 in the sheet feeding direction. Thus, a corner portion Sp of the leading edge Sh of the sheet Sj is located upstream of the upper edge portion 118*a* of the jam-handling guide surface 118 in the sheet feeding direction.

Figure 13A:
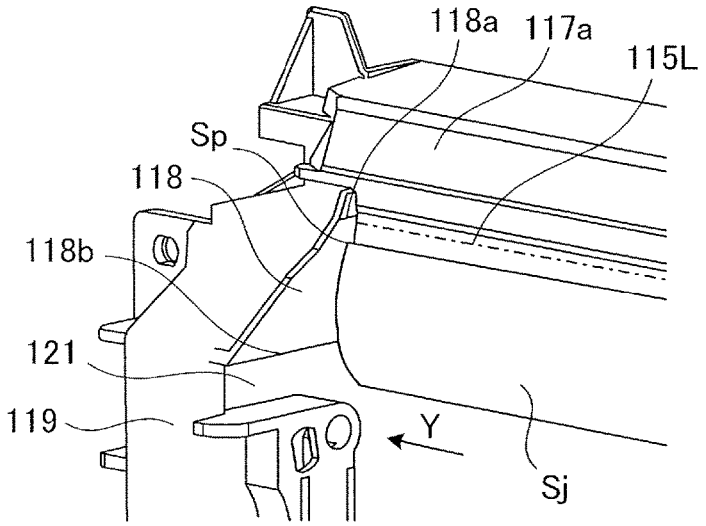
FIG. 13A is a perspective view illustrating a state where a corner portion of a sheet abuts against the jam-handling guide surface.
Figure 13B:
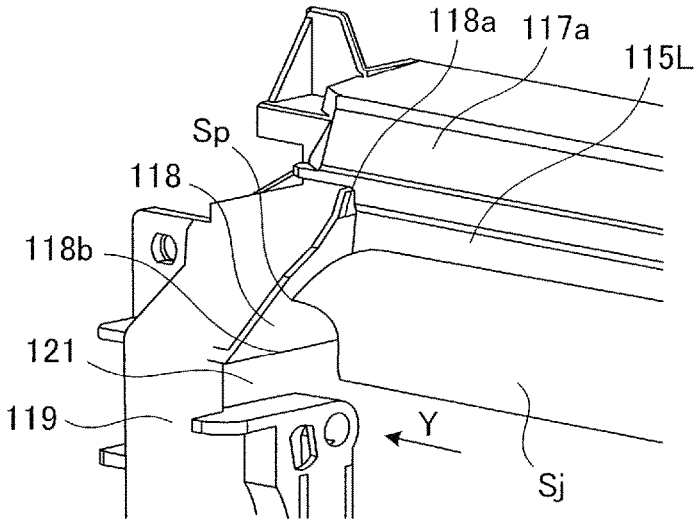
FIG. 13B is a perspective view illustrating a state where the corner portion of the sheet is being guided by the jam-handling guide surface.

When the cassette 106 is drawn in the drawing direction (indicated by the arrow Y) in such a state, the separation nip between the feed roller 107 and the retard roller 108 is released as described above, and the sheet Sj is drawn together with the cassette 106 by the side regulation plate 104R pushing the sheet Sj. Consequently, the corner portion Sp of the sheet Sj abuts against the jam-handling guide surface 118 as illustrated in FIG. 13A, and is gradually guided toward the opening 121 by the jam-handling guide surface 118, as illustrated in FIG. 13B. In this time, since the corner portion Sp of the sheet Sj is located upstream of the upper edge portion 118*a* of the jam-handling guide surface 118 in the sheet feeding direction, the corner portion Sp can be smoothly guided toward the opening 121, without caught by other members.

Figure 13C:
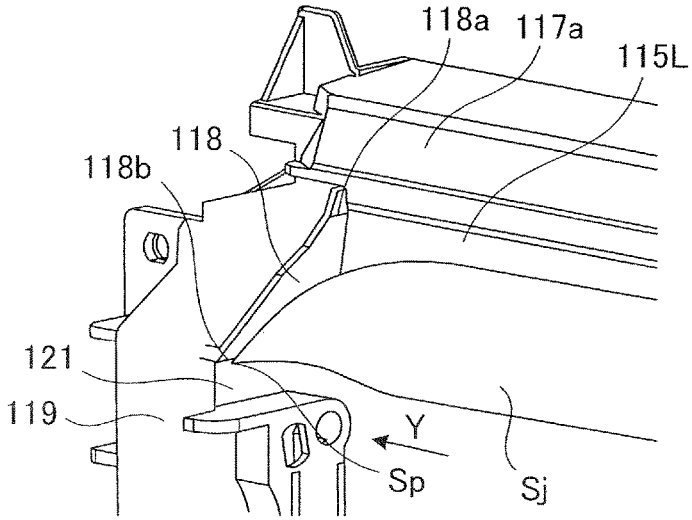
FIG. 13C is a perspective view illustrating a state where the corner portion of the sheet has reached an opening.

As illustrated in FIG. 13C, when the cassette 106 is further drawn, the corner portion Sp reaches the lower edge portion 118*b* of the jam-handling guide surface 118, and is discharged from the printer body 201 to the outside through the opening 121. Thus, since the jammed sheet Sj is smoothly guided to the opening 121 of the feed frame 119 by the j am-handling guide surface 118, the jam handling performance can be improved while the sheet Sj is prevented from being torn. The sheet Sj is discharged from the printer body 201 to the outside through the opening 121. Commonly, the feed frame 119 is provided outside the sheet conveyance area to support the feed shaft 107A of the feed unit 10 and other components. Since the opening 121 is formed in the feed frame 119, the sheet Sj can be discharged from the printer body 201 to the outside, while the feed frame 119 supports the feed shaft 107A and the other components. Here, if the opening 121 is too large, the strength of the feed frame 119 may be reduced. For this reason, it is preferable that the opening 121 has a size which does not prevent the passage of the sheet Sj, and does not reduce the strength of the feed frame 119. Specifically, it is preferable that the size of the opening 121 in the vertical direction is about 5 to 20 mm.

Modification

Figure 14:
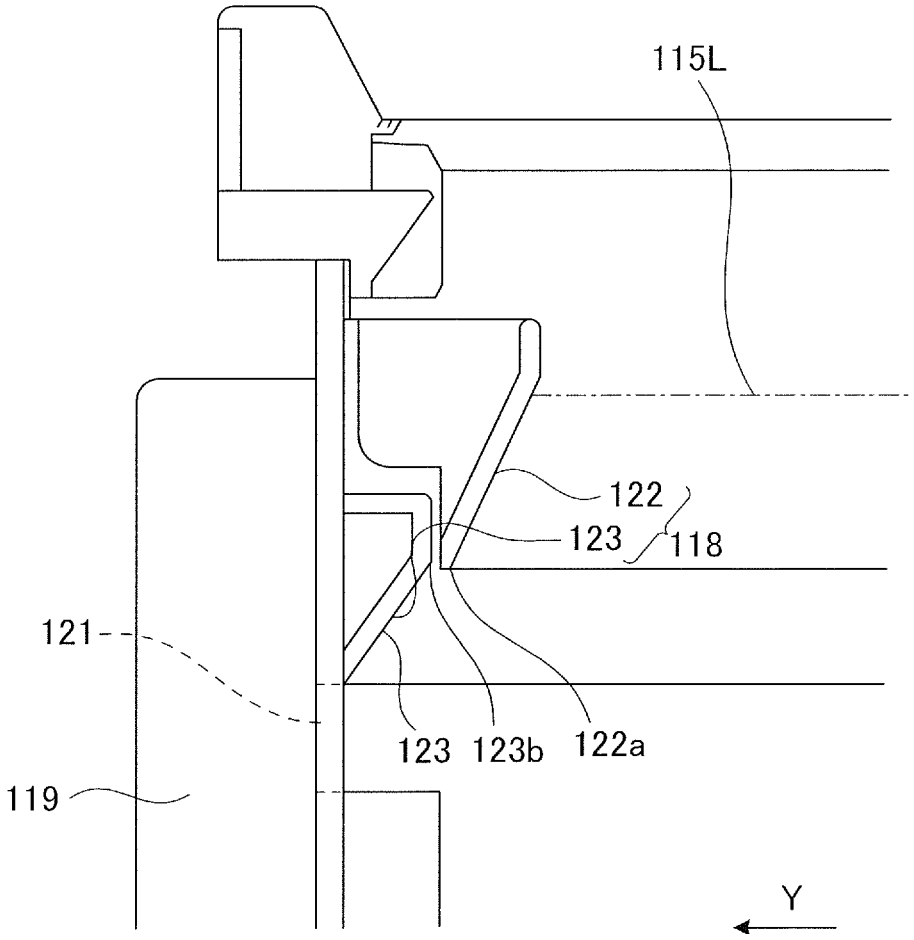
FIG. 14 is a schematic diagram illustrating a modification of the first embodiment.

In the above-described embodiment, the jam-handling guide surface 118 is a single surface which is flat and continuous. The present disclosure, however, is not limited to this. For example, the jam-handling guide surface 118 may be divided into two surfaces, as illustrated in FIG. 14. That is, the jam-handling guide surface 118 may be constituted by a first guide surface 122 protruding from the first conveyance guide 117*a* and a second guide surface 123 protruding from the feed frame 119. Thus, each of the first guide surface 122 and the second guide surface 123 may be formed integrally with one of the first conveyance guide 117*a*, the second conveyance guide 117*b*, and the feed frame 119.

Preferably, a lower edge portion 122*a* of the first guide surface 122 is positioned lower than an upper edge portion 123*b* of the second guide surface 123, and upstream of the upper edge portion 123*b* of the second guide surface 123 in the drawing direction. With this arrangement, the upper edge portion 123*b* of the second guide surface 123 is covered with the first guide surface 122 in the drawing direction, and thus the corner portion Sp of the jammed sheet Sj can be smoothly guided to the opening 121. The jam-handling guide surface 118 may be divided into three or more surfaces.

The plurality of surfaces obtained by dividing the jam-handling guide surface 118 can increase flexibility in design for molds, which are used in mass production in which the jam-handling guide surface 118 is molded with resin material. The design having increased flexibility can improve efficiency in mass production, and reduce costs.

Second Embodiment

Next, a second embodiment of the present invention will be described. In the first embodiment, the jam-handling guide surface 118 is formed integrally with the first conveyance guide 117*a*. But in the second embodiment, a jam-handling guide surface 126 is formed integrally with the second conveyance guide 117*b*. Thus, the same components as those of the first embodiment are omitted in the drawings, or described with the same symbols given to the drawings.

Figure 15:
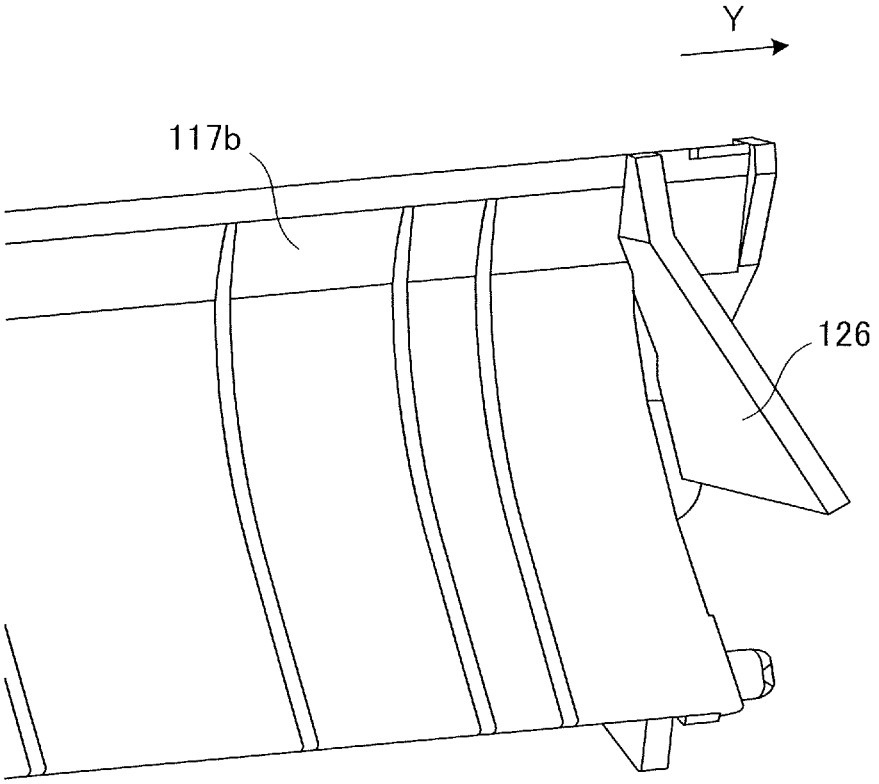
FIG. 15 is a perspective view illustrating a jam-handling guide surface and a second conveyance guide of a second embodiment.
Figure 16:
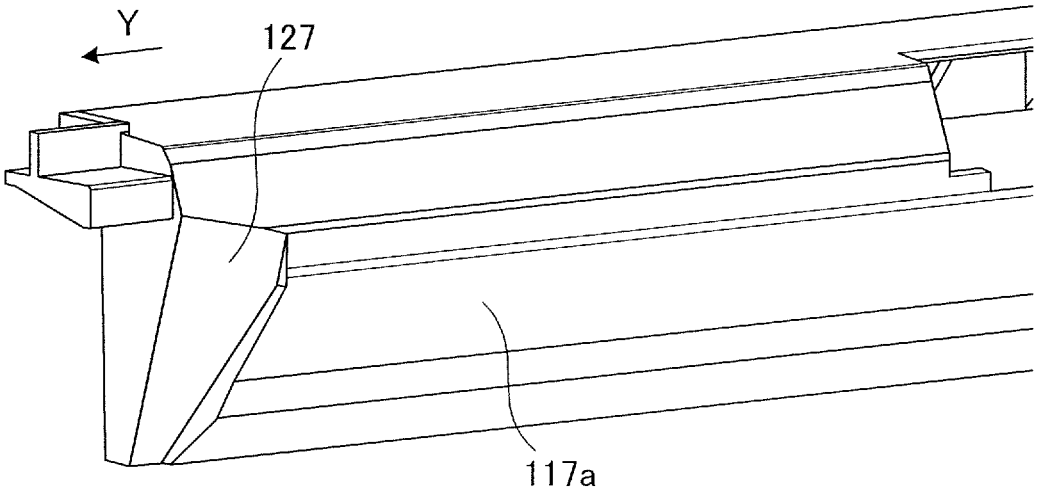
FIG. 16 is a perspective view illustrating a first conveyance guide and a concave portion.

As illustrated in FIG. 15, the jam-handling guide surface 126 which is an abutment surface is formed integrally with the second conveyance guide 117*b*, and extends toward the first conveyance guide 117*a*. In addition, a concave portion 127 is formed in the first conveyance guide 117*a*, as illustrated in FIG. 16. The concave portion 127 is formed so that the jam-handling guide surface 126, which protrudes from the second conveyance guide 117*b*, is placed in the concave portion 127. Thus, when viewed in the drawing direction, the jam-handling guide surface 126 overlaps with the conveyance path 117 (see FIG. 2) and the first conveyance guide 117*a*. Thus, as in the first embodiment, the jam-handling guide surface 126 can smoothly guide a jammed sheet to the opening 121 (see FIG. 12), increasing the jam handling performance.

Third Embodiment

Next, a third embodiment of the present invention will be described. Although the jam-handling guide surface is formed integrally with the first conveyance guide 117*a* or the second conveyance guide 117*b* in the first or the second embodiment, the present disclosure is not limited to this. That is, in the third embodiment, a jam-handling guide surface 124 is formed integrally with the feed frame 119. The same components as those of the first embodiment are omitted in the drawings, or described with the same symbols given to the drawings.

Figure 17:
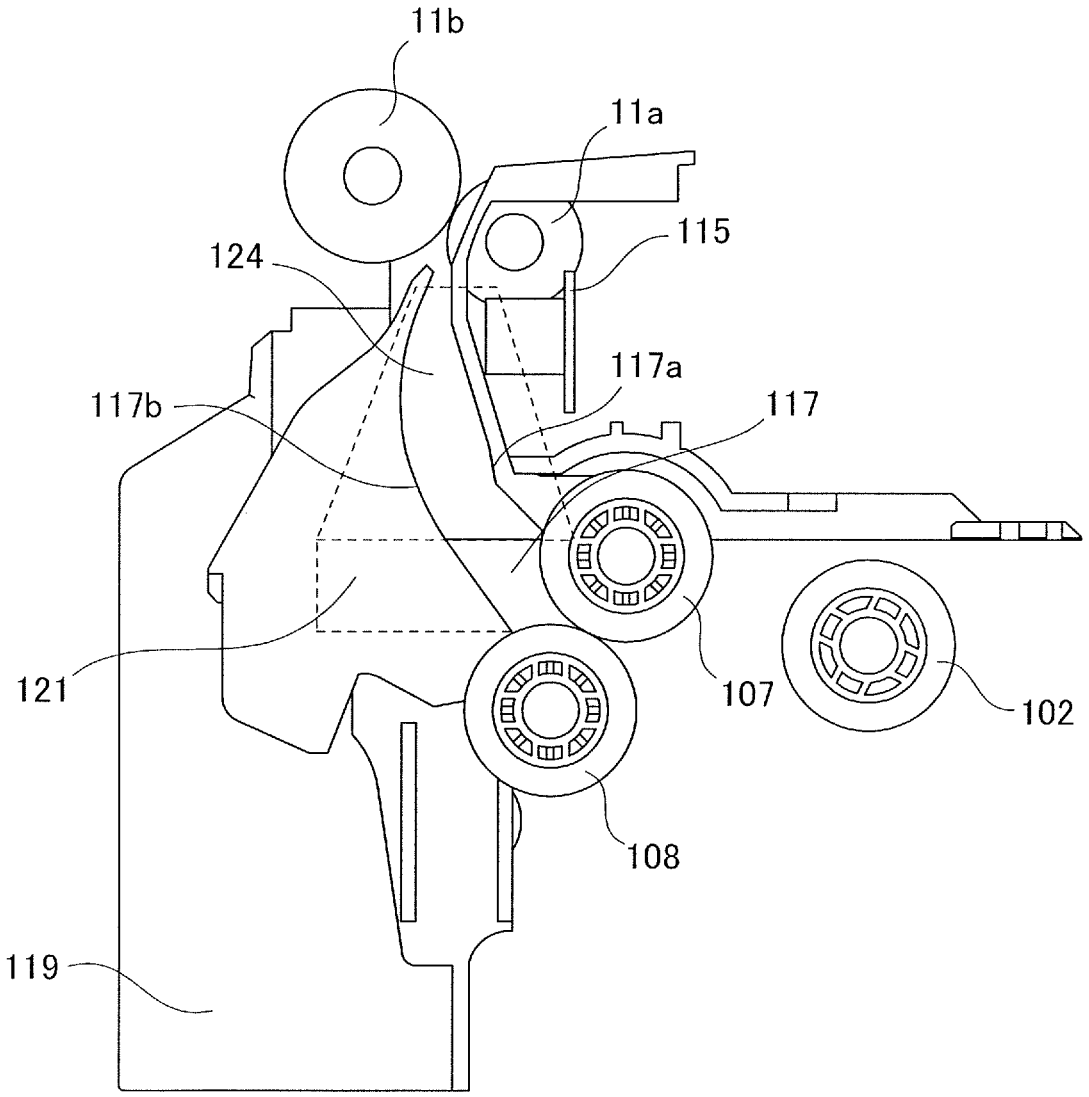
FIG. 17 is a schematic diagram illustrating a jam-handling guide surface of a third embodiment.
Figure 18:
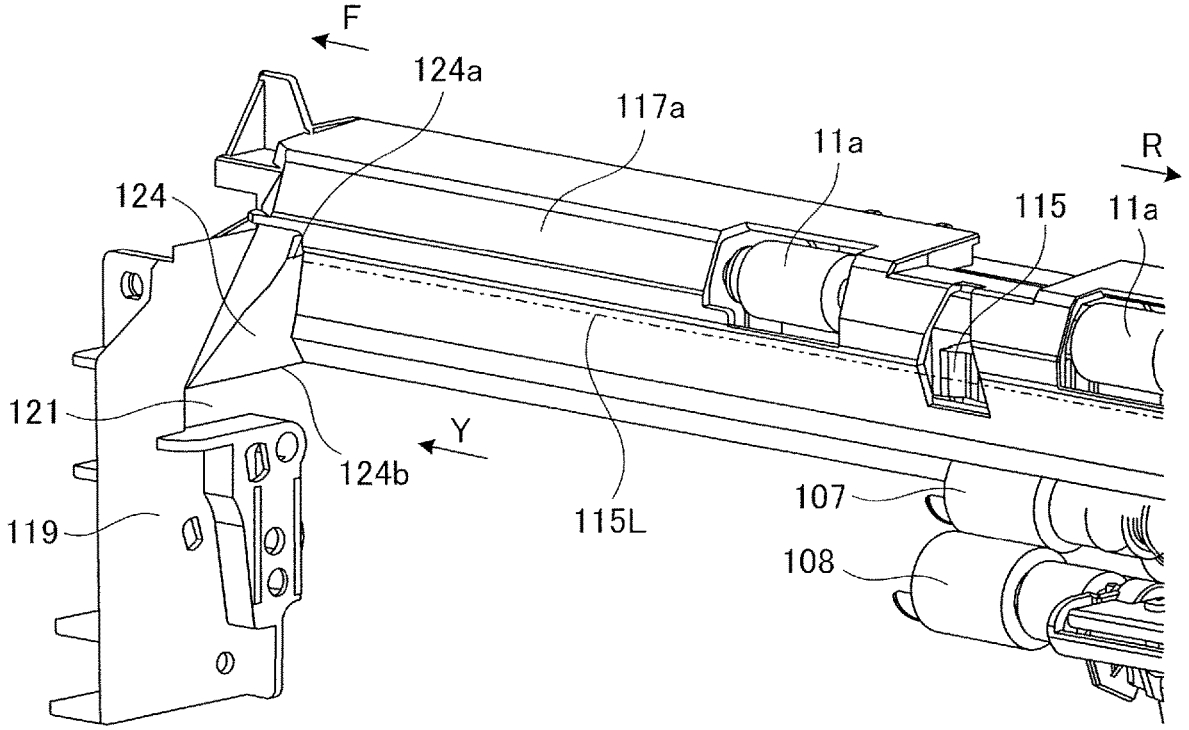
FIG. 18 is a perspective view illustrating the jam-handling guide surface.

As illustrated in FIGS. 17 and 18, the jam-handling guide surface 124 which is an abutment surface is formed integrally with the feed frame 119, and extends from a first conveyance guide 117*a* side toward a second conveyance guide 117*b* side. The jam-handling guide surface 124 has an upper edge portion 124*a* and a lower edge portion 124*b*, whose shapes are the same as those of the upper edge portion 118*a* and the lower edge portion 118*b* of the first embodiment. When viewed in the drawing direction, the jam-handling guide surface 124 overlaps with the second conveyance guide 117*b*, the conveyance path 117, and the first conveyance guide 117*a*. Thus, as in the first embodiment, the jam-handling guide surface 124 can smoothly guide a jammed sheet to the opening 121, increasing the jam handling performance.

The jam-handling guide surface 124 may be formed not integrally with, but separately from the feed frame 119. For example, the jam-handling guide surface 124 may be a sheet material, such as a PET sheet. In addition, the jam-handling guide surface 124 may not extend from the first conveyance guide 117*a* side toward the second conveyance guide 117*b* side, and may extend from the second conveyance guide 117*b* side toward the first conveyance guide 117*a* side. In the above-described embodiments, the jam-handling guide surface may not be flat. For example, the jam-handling guide surface may be curved.

In addition, although the embodiments have been described for the case where the electrophotographic printer 200 is used, the present invention is not limited to this. For example, the present invention may also be applied to an ink-jet image forming apparatus that forms images on sheets by injecting ink from its nozzle.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-023367, filed Feb. 13, 2018, which is hereby incorporated by reference herein in its entirety.

What is claimed is:

1. A sheet feeding apparatus comprising:

an apparatus body;

a drawer unit, drawn from and attached to the apparatus body, comprising a sheet supporting portion configured to support a sheet;

a feeding roller, provided in the apparatus body, configured to feed the sheet supported by the sheet supporting portion in a sheet feeding direction orthogonal to a drawing direction in which the drawer unit is drawn;

a conveyance roller pair, provided in the apparatus body, configured to convey the sheet fed by the feeding roller;

a first conveyance guide and a second conveyance guide, provided in the apparatus body, facing each other and forming a conveyance path through which the sheet fed from the feeding roller toward the conveyance roller pair passes;

an abutment surface provided in the apparatus body and disposed downstream of the conveyance path in the drawing direction; and a frame, provided in the apparatus body, defining an opening disposed below the abutment surface and opened toward the drawing direction, wherein the abutment surface is configured to abut against the sheet and guide the sheet toward the opening in a case where the drawer unit is drawn from the apparatus body in a state where the sheet remains in the conveyance path, and a size of the opening in a vertical direction is 5 to 20 mm.

2. The sheet feeding apparatus according to claim 1, wherein the abutment surface guides the sheet such that the sheet passes through the opening in a case where the drawer unit is drawn from the apparatus body in the state where the sheet is stuck across the drawer unit and the conveyance path.

3. A sheet feeding apparatus comprising:

an apparatus body;

a drawer unit drawn from and attached to the apparatus body, comprising a sheet supporting portion configured to support a sheet;

a feeding roller, provided in the apparatus body, configured to feed the sheet, supported by the sheet supporting portion, in a sheet feeding direction orthogonal to a drawing direction in which the drawer unit is drawn;

a conveyance roller pair, provided in the apparatus body configured to convey the sheet fed by the feeding roller;

a first conveyance guide and a second conveyance guide, provided in the apparatus body, facing each other and forming a conveyance path through which the sheet fed from the feeding roller toward the conveyance roller pair passes; and an abutment surface, formed integrally with the first conveyance guide and disposed downstream of the conveyance path in the drawing direction, configured to abut against the sheet and guide the sheet toward the drawer unit in a case where the drawer unit is drawn from the apparatus body in a state where the sheet remains in the conveyance path, the abutment surface comprising an upper edge portion and a lower edge portion, the abutment surface being inclined with respect to the drawing direction and the sheet feeding direction such that the upper edge portion is located upstream of the lower edge portion in the drawing direction, and is located downstream of the lower edge portion in the sheet feeding direction, wherein the abutment surface extends toward the second conveyance guide and overlaps with the second conveyance guide when viewed in the drawing direction.

4. The sheet feeding apparatus according to claim 3, wherein the apparatus body comprises a frame defining an opening disposed below the abutment surface and opened toward the drawing direction, and wherein the abutment surface guides the sheet toward the opening in a case where the drawer unit is drawn from the apparatus body in a state where the sheet remains in the conveyance path.

5. The sheet feeding apparatus according to claim 4, wherein a size of the opening in a vertical direction is 5 to 20 mm.

6. The sheet feeding apparatus according to claim 4, wherein the abutment surface guides the sheet such that the sheet passes through the opening in a case where the drawer unit is drawn from the apparatus body in the state where the sheet remains in the conveyance path.

7. The sheet feeding apparatus according to claim 3, further comprising:

a sensor disposed downstream of the feeding roller and upstream of the conveyance roller pair in the sheet feeding direction, and configured to detect the sheet being located in the conveyance path; and a display unit configured to display an instruction screen which instructs a user to draw the drawer unit in a case where the sensor does not detect the sheet within a predetermined time measured from when the feeding roller starts to feed the sheet.

8. The sheet feeding apparatus according to claim 3, wherein the conveyance path extends upward toward the conveyance roller pair while curving when viewed in the drawing direction.

9. The sheet feeding apparatus according to claim 3, wherein the conveyance path is opened in a case where the second conveyance guide is separated from the first conveyance guide.

10. An image forming apparatus comprising:

the sheet feeding apparatus according to claim 3; and an image forming portion configured to form an image on a sheet fed by the sheet feeding apparatus.

* * * * *